United States Patent [19]

Kamon et al.

[11] Patent Number: 4,874,316

[45] Date of Patent: Oct. 17, 1989

[54] CONNECTOR APPARATUS

[75] Inventors: Yoshiyuki Kamon; Akira Ogiwara, both of Kanagawa; Koji Nageno, Tokyo, all of Japan

[73] Assignee: Sony Corporation, Tokyo, Japan

[21] Appl. No.: 180,847

[22] Filed: Apr. 12, 1988

[30] Foreign Application Priority Data

Apr. 30, 1987 [JP] Japan ..... 62-107342

[51] Int. Cl.[4] ..... H01R 11/30

[52] U.S. Cl. ..... 439/39; 439/374; 439/923

[58] Field of Search ..... 439/38, 39, 40, 152, 439/180, 923, 374

[56] References Cited

U.S. PATENT DOCUMENTS

| | | | |
|---|---|---|---|
| 2,170,287 | 8/1939 | Kinnebrew | 439/180 |
| 3,521,216 | 7/1970 | Tolegian | 439/335 |
| 3,808,577 | 4/1974 | Mathauser | 439/39 |
| 3,810,258 | 5/1974 | Mathauser | 439/39 |
| 4,025,964 | 5/1977 | Owens | 439/40 |
| 4,112,941 | 9/1978 | Larimore | 439/153 |

*Primary Examiner*—Neil Abrams
*Assistant Examiner*—Khiem Nguyen
*Attorney, Agent, or Firm*—Philip M. Shaw, Jr.

[57] ABSTRACT

A connector apparatus having a connector socket and a connector plug arranged such that respective contacts of the connector socket and connector plug are kept in contact with each other by magnetic force, whereby when unintentional tension is applied to a cord, the cord can be prevented from being broken and the connector socket and the connector plug can be easily coupled to and/or removed from each other.

5 Claims, 6 Drawing Sheets

CONNECTOR APPARATUS

BACKGROUND OF THE INVENTION

1. Field of the Invention

The present invention relates generally to connector apparatus and more particularly to a connector apparatus for coupling audio equipment to each other.

2. Description of the Prior Art

Various connector apparatus have been proposed to interconnect audio equipment. As is disclosed in greater detail, for example, in Japanese Published Utility Model Application No. 60-29833, usually the connector apparatus is formed as a connector system in which a connector plug is inserted into a connector socket (jack). According to the above conventional connector system, when the connector plug is inserted into the connector socket, the connector plug is held by the spring members of the contact of the connector socket.

In such a conventional connector apparatus, when unintentional tension is applied in the axial direction of the cord, the connector plug is pulled out of the connector socket. If, however, the tension is applied in the direction perpendicular to the axial direction of the cord and the connector plug, the connector plug cannot be pulled out of the connector socket In this case the cord may be broken or the user's head may be injured by a headphone attached to the cord.

OBJECTS AND SUMMARY OF THE INVENTION

Accordingly, it is an object of this invention to provide an improved connector apparatus.

It is another object of this invention to provide a connector apparatus in which a connector plug can easily be removed from a connector socket even when an unintentional tension is applied to the cord.

It is a further object of this invention to provide a connector apparatus in which a headphone cord can be prevented from being broken and which prevents injury to the user from the headphone.

According to one aspect of the present invention, there is provided a connector apparatus comprising:

a) plug means having a plurality of first signal terminals;

b) socket means having a plurality of second signal terminals which correspond to said first signal terminals; and c) magnetic means for coupling said plug means to said socket means so that said plurality of first signal terminals and said plurality of corresponding second signal terminals contact with one another.

In the preferred embodiment of the invention the plug includes a first housing having a first contact face and convex and concave portions formed on said first contact face. A plurality of cords are accommodated in said first housing and a plurality of first terminals, each connected at one end to a separate one of said plurality of cords, are accommodated in said first housing and exposed to the outside at their other ends from one of said convex and concave portions A pair of metal plates are located at both sides of one of said convex and concave portions.

The socket includes a second housing having a second contact face and the other of said convex and concave portions formed on said second contact face. A plurality of second terminals are accommodated in said second housing and each is exposed at one end to the outside from the other of said convex and concave portions. A pair of metal plates are located at both sides of the other of said convex and concave portions on said second contact face and magnetic means contact said pair of metal plates.

These and other objects, features and advantages of the present invention will become apparent from the following detailed description of the preferred embodiments to be taken in conjunction with the accompanying drawings, throughout which like references identify like elements and parts.

BRIEF DESCRIPTION OF THE DRAWINGS

FIGS. 1A–1E are together a diagram showing an arrangement of a connector socket which forms an embodiment of a connector apparatus according to the present invention, wherein FIG. 1A is a plan view, FIG. 1B is a bottom view, FIG. 1C is a right side view, FIG. 1D is a cross-sectional view, with portions in elevation, taken generally along a line a–a′ of FIG. 1A and FIG. 1E is a cross-sectional view, with portions in elevation, taken generally along a line b–b′ of FIG. 1A;

FIGS. 2A–2E are together a diagram showing an arrangement of a connector plug which also forms the embodiment of the connector apparatus according to the present invention, wherein FIG. 2A is a plan view, FIG. 2B is a front view, FIG. 2C is a bottom view, FIG. 2D is a cross-sectional view, with portions in elevation, taken generally along a line c–c′ of FIG. 2A and FIG. 2E is a cross-sectional view, with portions in elevation, taken generally along a line d–d′ of FIG. 2A;

DESCRIPTION OF THE PREFERRED EMBODIMENTS

The present invention will now be described with reference to the attached drawings.

Figure 1A:
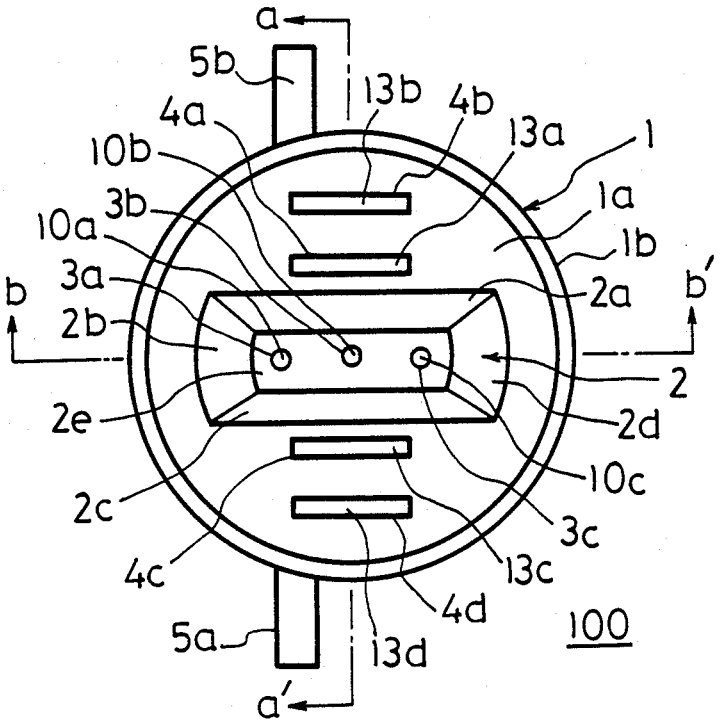
Figure 1B:
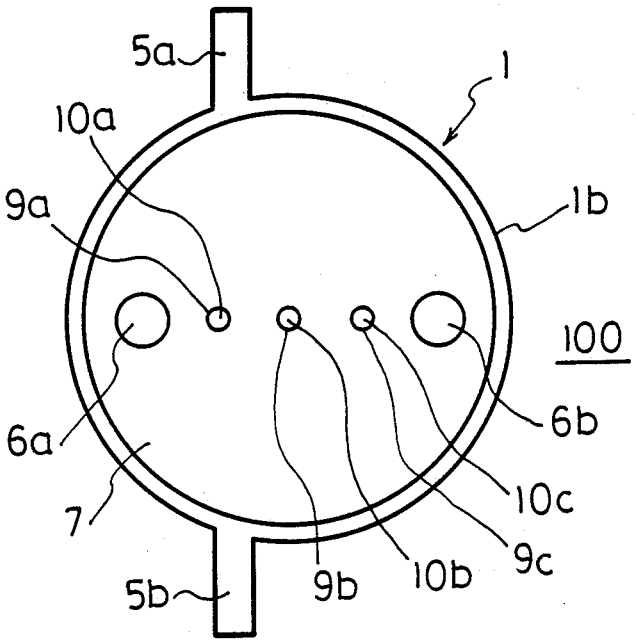
Figure 1C:
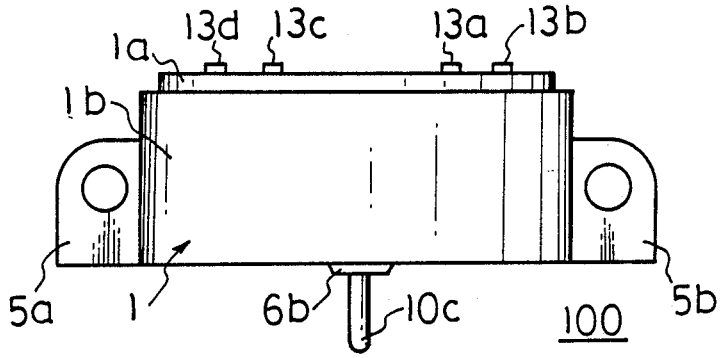
Figure 1D:
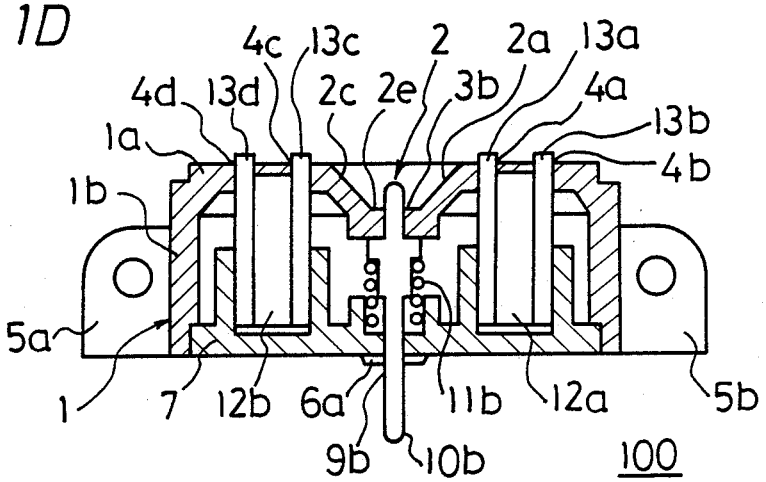
Figure 1E:
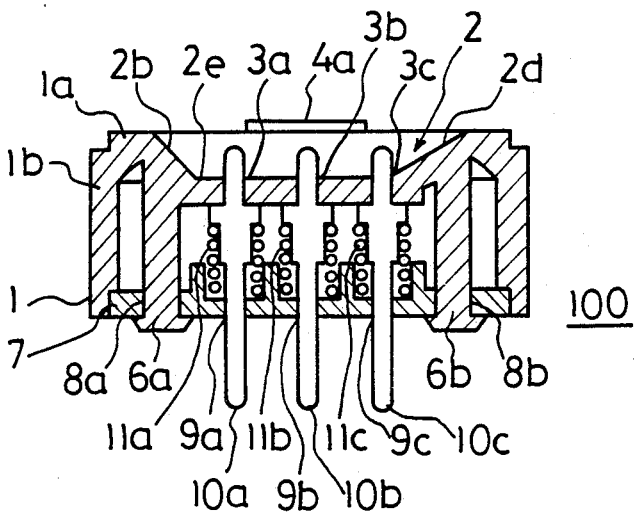

Referring to the FIGS. 1A to 1E, a can-shaped housing 1 is formed of an end or closure portion 1*a* and a side cylindrical portion 1*b*. This housing 1 or each of the portions 1*a* and 1*b* are made of, for example, ABS (acrylonitrile-butadiene-styrene copolymer) resin. A rectangular-shaped concave portion 2 is formed on the end portion 1*a* of this housing 1 at its center. The concave portion 2 has four side walls 2*a*, 2*b*, 2*c* and 2*d*, each of which is formed to have a predetermined inclination. In this case, as shown in FIG. 1E, the side wall 2*d* of the short side has an inclination smaller than that of the other opposing side wall 2*b*. Three circular openings 3*a*, 3*b*, and 3*c* are formed through the bottom 2*e* of the concave portion 2 along its longitudinal direction as shown in FIG. 1A. A first pair of rectangular-shaped openings 4*a*, 4*b* are aligned through the end portion 1*a* with the long side wall 2*a* of the concave portion 2 and are separated therefrom by a predetermined distance as shown in FIG. 1A. Similarly, a second pair of rectangular-shaped openings 4*c*, 4*d* are aligned through the end portion 1*a* with the long side wall 2*c* of the concave portion 2 and are separated therefrom by a predetermined distance as shown in FIG. 1A.

A pair of projecting lugs 5*a*, 5*b*, each having a circular opening are integrally formed with the side cylindrical portion 1b of the housing 1 as shown in FIG. 1C. The lugs 5a, 5b are used to secure the housing 1 to the panel or housing of acoustic appliances. As best viewed in FIG. 1E, projecting from the inner surface of the end portion 1a are a pair of rod-shaped protrusions 6a, 6b. They extend downward, as shown in FIG. 1E.

A disk-shaped lid 7 made of, for example, ABS resin, is engaged into the stepped portion formed at the open end of the housing 1 as shown in FIGS. 1B, 1D and 1E. Circular openings 8a, 8b are formed through the lid 7 in alignment with the pair of protrusions 6a, 6b formed in the housing 1, as shown in FIG. 1E. When the lid 7 is engaged into the stepped portion formed at the opening end of the housing 1, the protrusions 6a, 6b enter through the openings 8a, 8b and the heads of the protrusions 6a, 6b protruding beyond the lid 7 are flattened to be larger than the diameters of the openings 8a, 8b. Thus, the lid 7 is effectively riveted to the housing 1.

Circular openings 9a, 9b and 9c are formed through the lid 7 in alignment with the openings 3a to 3c formed through the concave portion 2 of the housing 1. As shown in FIG. 1E, seated in these openings 9a to 9c are pins 10a to 10c made of, for example, brass plated with nickel and gold so as to prevent corrosion. The diameters of the central portions of these pins 10a to 10c are selected to be larger than those of the openings 3a to 3c formed through the housing 1 and those of the openings 9a to 9c formed through the lid 7. Also, these pins 10a to 10c form at their sides near the openings 3a to 3c shoulders which are larger in diameter than the diameters of center portions of these pins 10a to 10c, and the other portions thereof are selected to be smaller than those of the openings 3a to 3c and 9a to 9c. One end of each of the pins 10a to 10c are engaged through the openings 3a to 3c of the housing 1, while the other ends thereof are engaged through the openings 9a to 9c of the lid 7. Springs 11a to 11c are each provided between the shoulders of these pins 10a to 10c and the lid 7, whereby the pins 10a to 10c are resiliently movable from the illustrated states in FIG. 1E from the lid 7 side. At the same time, these pins 10a to 10c are spring-biased towards the end portion 1a side of the housing 1 to be returned to the illustrated states in FIG. 1E. By way of example, one end of each of the pins 10a, 10b and 10c protrudes from the end portion 1b from the openings 3a, 3b and 3c formed through the housing 1 These pin ends serve, respectively, as the right audio signal contact, earth contact and left audio signal contact for a passenger entertainment system, for example, which is to be understood as being connected to these pins 10a to 10c, although not shown.

As illustrated in FIG. 1D, magnets 12a, 12b are respectively located between the openings 4a, 4b and 4c, 4d in the housing cavity formed between the end portion 1a of the housing 1 and the lid 7. Magnet plates 13a, 13b, made of iron which are plated by nickel, are mounted to both side walls of the magnet 12a. The upper end portions of these magnet plates 13a, 13b are engaged through the openings 4a, 4b and protrude from the upper surface of the housing 1 Similarly, magnet plates 13c, 13d, made of iron which are plated by nickel, are mounted to both side walls of the magnet 12b. The upper end portions of these magnet plates 13c, 13d are engaged through the openings 4c, 4d and protrude from the upper surface of the housing 1.

FIG. 2 illustrates a connector plug 200 which, together with the socket of FIGS. 1A to 1E, forms the connector apparatus of the present invention.

Figure 2A:
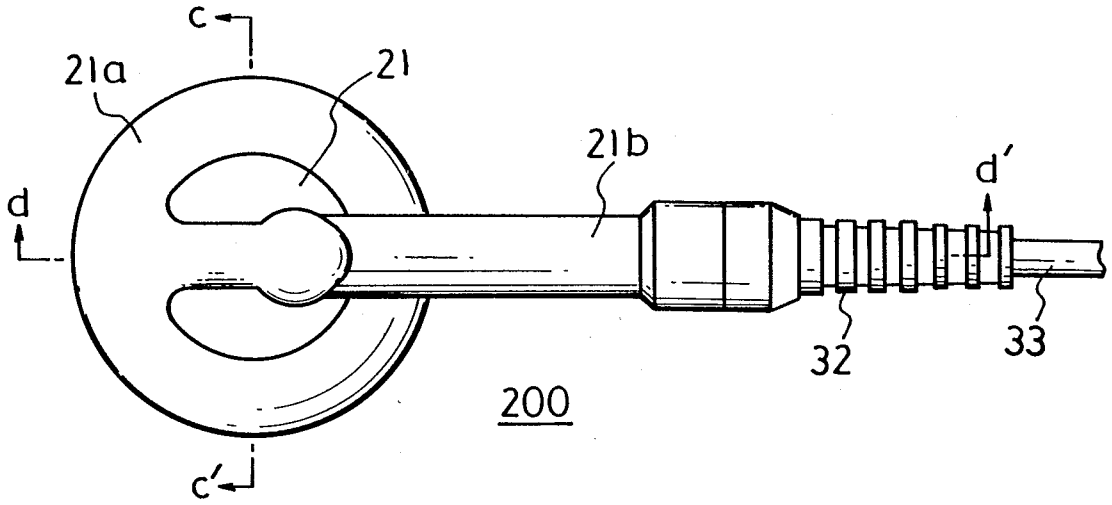
Figure 2B:
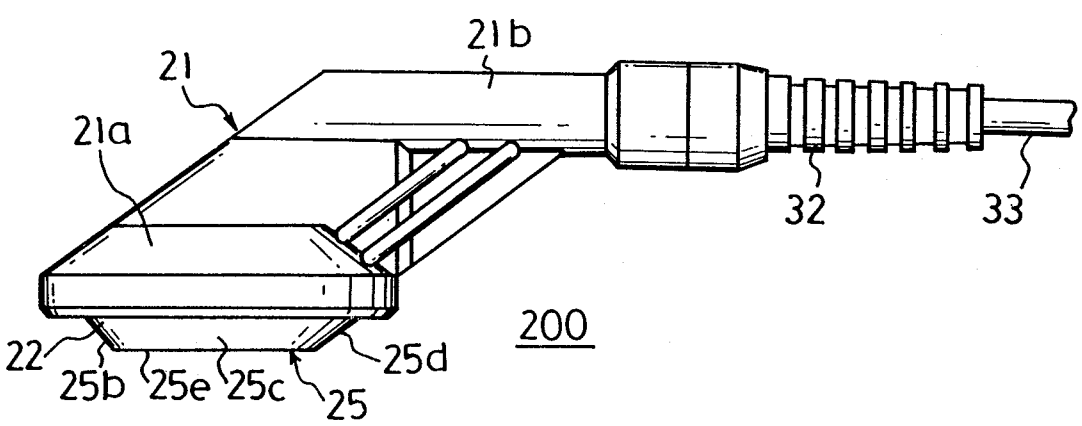
Figure 2C:
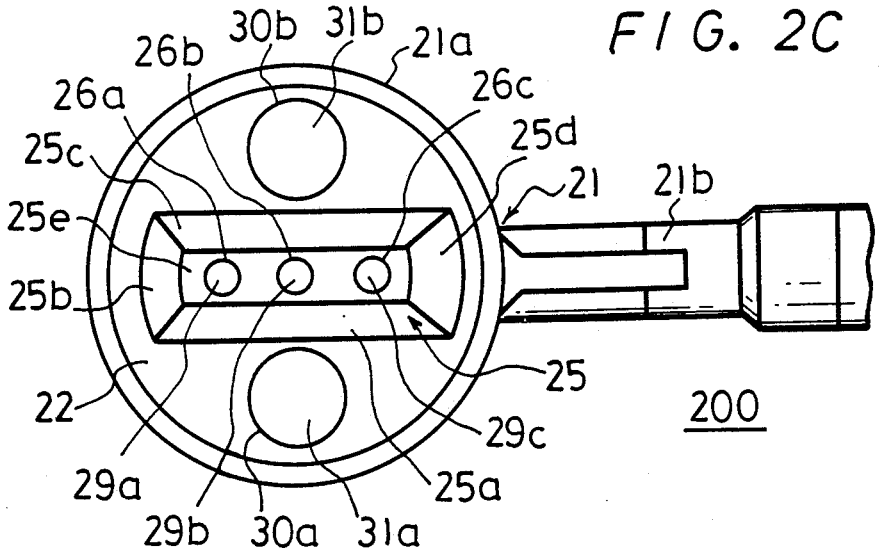

Referring to the FIGS. 2A to 2E, there is provided a housing 21 formed of a terminal compartment portion 21a, in the shape of a circular truncated cone, and a cylindrically-shaped cord compartment portion 21b. The housing 21 or each of the portions 21a and 21b is made of, for example, ABS resin. A disk-shaped lid 22 is made of, for example, ABS resin and a plurality of extensions 23 are formed around the outer peripheral portion of the lid 22 as shown in in. 2E. These extensions 23 are engaged with a plurality of grooves 24 formed around the opening portion side of the terminal compartment portion 21a, thus the lid 22 being fixed to the housing 21. On the center of the lid 22, there is formed a convex portion 25 which is engaged with the concave portion 2 formed at the center of the end portion 1a of the above-mentioned housing 1. The convex portion 25 is formed of four side walls 25a, 25b, 25c and 25d, each having a predetermined inclination. As shown in FIGS. 2B and 2C, the angle of inclination of one short side wall 25d is selected to be smaller than that of the other or opposing side wall 25b. Thus the mating portions of the plug and the socket are each in the shape of a truncated pyramid but with one side of the pyramid having a different angle of inclination than all of the other sides.

Three circular openings 26a, 26b and 26c are formed through a bottom 25e of the convex portion 25 along the longitudinal direction thereof A base plate 27 is mounted within the terminal compartment portion 21a, and circular openings 28a, 28b and 28c are formed through this base plate 27 in alignment with the openings 26a to 26c formed through the above-mentioned lid 22.

A set of terminals 29a, 29b and 29c are each made of, for example, brass which is plated with nickel and gold so as to prevent corrosion. These terminals 29a to 29c each have central portions which are larger in diameter than the inner diameters of the openings 26a to 26c and 28a and end portions near the lid 22 and the base plate 27 which are smaller in diameter than the inner diameters of the openings 26a to 26c and 28a to 28c. One end of each of these terminals 29a to 29c is engaged, respectively, through the openings 26a to 26c of the lid 22 and the end surface thereof is on substantially the same plane as the surface of the lid 22. The other end of each of the terminals 29a to 29c protrudes through the openings 28a to 28c of the base plate 27 to its outside. In this case, the terminals 29a, 29b and 29c are used as a right audio signal contact, an earth contact and a left audio signal contact, respectively.

Figure 2D:
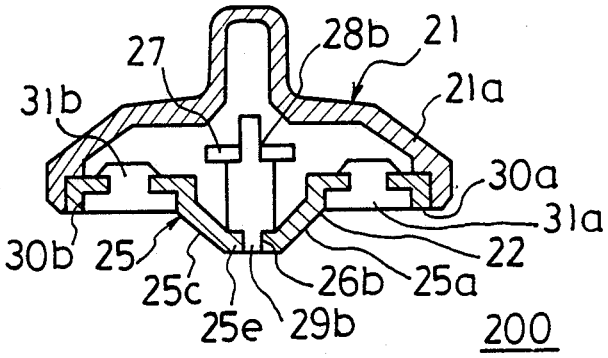
Figure 2E:
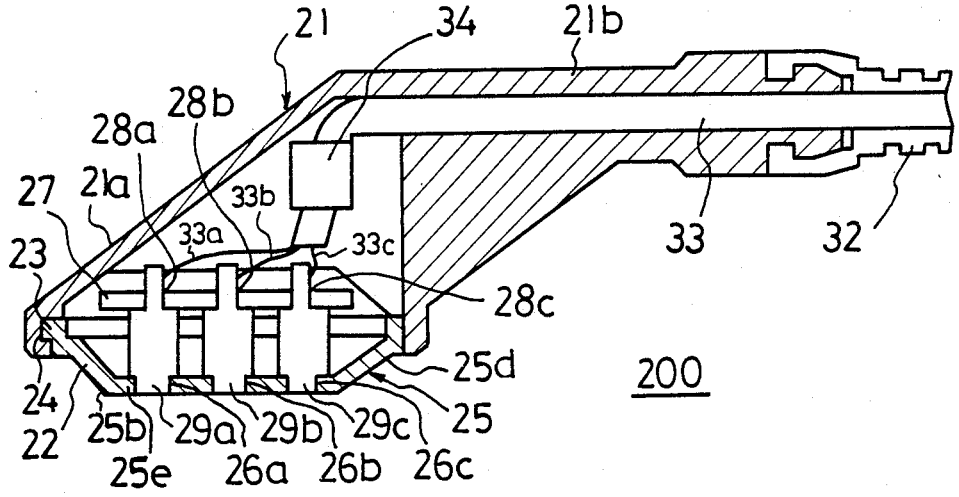

Alongside and radially outward from the long side portions 25a, 25c of the convex portion 25 of the lid 22, there are formed circular openings 30a and 30b, respectively, as shown in FIGS. 2C and 2D. These openings 30a and 30b are arranged to have stepped portions of which the lower surfaces, as viewed in the figures, are made larger in diameter. Into these openings 30a and 30b, there are inserted stepped-shaped plates 31a, 31b formed to correspond in shape to these openings 30a and 30b. These plates 31a, 31b are each made of, for example, iron which is plated with nickel The portions of these plates 31a, 31b which protrude to the upper surface side of the lid 22, as viewed in the figures, are flattened to be larger than the inner diameters of the openings 30a, 30b, thereby fixing the plates 31a and 31b to the lid 22.

The connector plug 200 further includes a bushing 32 made of, for example, vinyl chloride, a cord 33 and a cord support member 34. Separate lead wires 33*a*, 33*b*, and 33*c* led from the cord 33 are soldered, respectively, to the terminals 29*a* to 29*c* that protrude from the base plate 27. To the other end of the cord 33, there is connected, for example, a headphone (not shown).

In this embodiment, the connector socket 100 and the connector plug 200 are formed as described above. In operation, when the connector plug 200 is coupled to the connector socket 100, as shown in FIGS. 3 and 4, the concave portion 2 formed at the center of the end portion 1*a* of the housing 1 of the connector socket 100 is engaged with the convex portion 25 formed at the center of the lid 22 of the connector plug 200.

Figure 3:
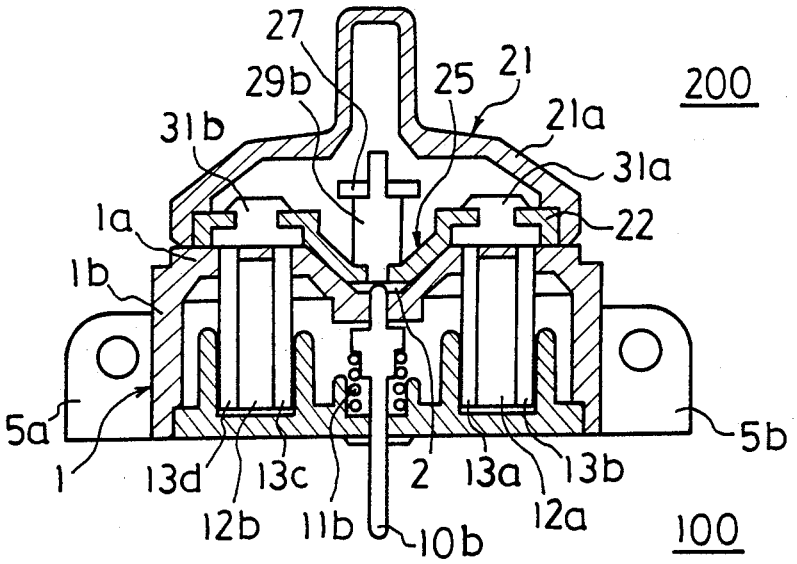
FIGS. 3 and 4 are vertical sectional views, with portions in elevation, of the assembled connector assembly.

In this case, as shown in FIG. 3, the plates 31*a*, 31*b* fixed to the lid 22 of the connector plug 200 respectively contact with the upper end portions of the magnet plates 13*a*, 13*b*, 13*c* and 13*d* protruding from the end portion 1*a* of the housing 1 of the connector socket 100 so that the connector plug 200 is held in the engaged state with the connector socket 100 by magnetic force.

Figure 4:
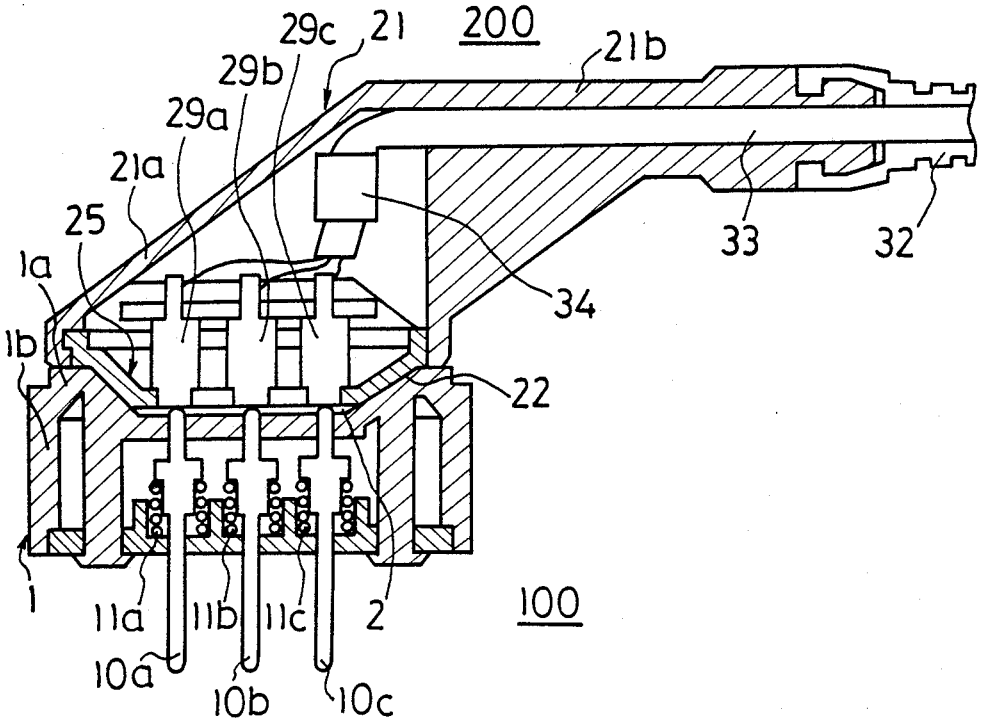

Further, in this case, as shown in FIG. 4, the pins 10*a* to 10*c* extend to the concave portion 2 of the housing 1 of the connector socket 100 and contact with he terminals 29*a* to 29*c*, respectively, appearing on the surface of the lid 22 of the connector plug 200 so that conductive connections between them are established. Upon connection of the parts 100 and 200 as above described, the pins 10*a* to 10*c* are forced back into the housing 1 and are urged against the terminals 29*a* to 29*c* by the forces of the springs 11*a* to 11*c* and contact therewith positively.

In accordance with this embodiment, as described hereinabove, when the connector plug 200 is coupled to the connector socket 100, they are kept in contact with each other by magnetic force so that the connector plug 200 can easily be removed from the connector socket 100 if unintentional tension is applied to the cord 33. In addition, according to this embodiment, since the side walls 2*a* to 2*d* of the concave portion 2 of the connector socket 100 and the side walls 25*a* to 25*d* of the convex portion 25 of the connector plug 200 are formed to have the predetermined inclinations, the connector plug 200 can easily be removed from the connector socket 100 by the tension applied to the axial direction of the cord 33. Further, since the connector plug 200 has the cord compartment portion 21*b* extending in the axial direction of the cord 33, by lever action the connector plug 200 is taken off from the connector socket 100 when only a slight is tension applied in the direction perpendicular to the axial direction of the cord 33. In other words, the connector plug 200 can easily be removed from the connector socket 100 regardless of the direction in which the tension is applied. Therefore, according to the present invention, the cord 33 can be prevented from being broken and also the user wearing a headphone connected to the cord is protected from being injured on the head.

Further, according to this embodiment, since one side wall 2*d* of the short side of the concave portion 2 of the connector socket 100 has an inclination smaller than that of the other side wall 2*b* and one side wall 25*d* of the short side of the convex portion 25 of the connector plug 200 has an inclination smaller than that of the other side wall 25*b* in correspondence therewith, the direction in which the connector plug 200 is coupled to the connector socket 100 is uniformly determined. Thus, the left and right audio signals are prevented from being supplied to the headphone in the reverse order.

Furthermore, according to the present invention, since the connector plug 200 is coupled to the connector socket 100 without friction, unlike a conventional socket system, there is then the advantage that the connector plug 200 can be coupled to and/or removed from the connector socket 100 with ease.

Figure 5:
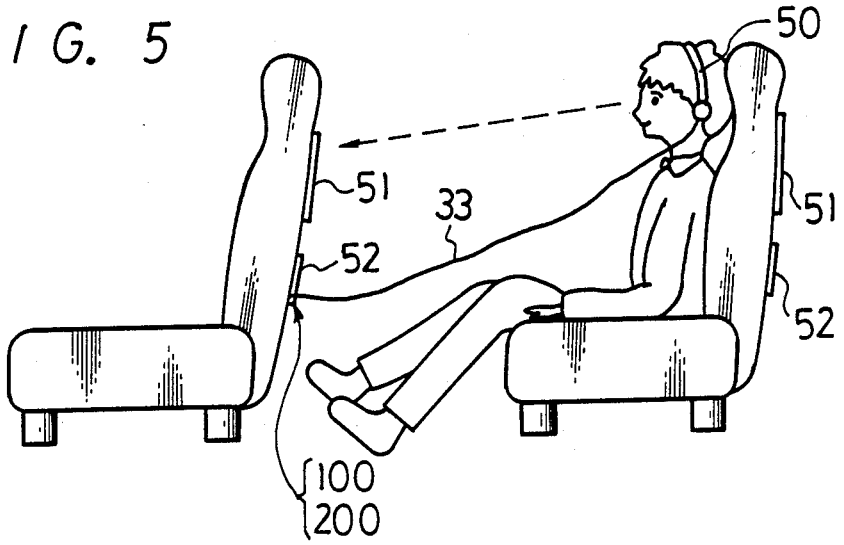
FIG. 5 is an illustration used to show the environment of the present invention.

This embodiment can achieve the above-mentioned action and effect, and the connector apparatus of the present invention is suitable for use in a passenger entertainment system as, for example, shown in FIG. 5, where connector sockets 100 are provided at each of the passenger seats of a passenger vehicle such as aircraft, train, bus or the like and are easily connected with connector plugs 200 connected to headphones 50. In FIG. 5, reference 51 designates a display apparatus and 52 a control panel.

In the above-mentioned embodiment, the positions of the pins 10*a* to 10*c* and the magnet plates 13*a* to 13*d* of the connector socket 100 and the positions of the terminals 29*a* to 29*d* and the plates 31*a* to 31*b* of the connector plug 200 may be reversed, respectively. Further, the number of the pins and terminals are not limited to sets of three but can be selected to be any desired number.

Figure 6A:
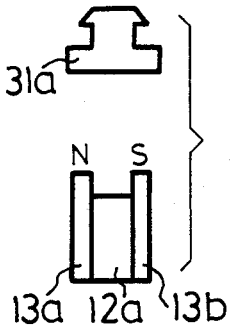
FIGS. 6A to 6E are respectively diagrams showing examples of modifications to the present invention.
Figure 6B:
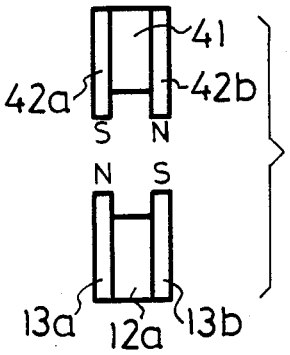
Figure 6C:
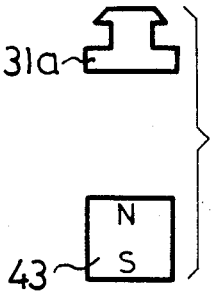
Figure 6D:
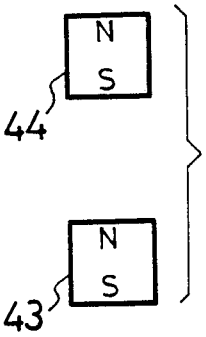

In the above embodiment, as shown in FIGS. 6A and 6B, the plates 31*a* and 31*b* provided at the connector plug 200, can be replaced by a pair of magnets 41 gripped by magnet plates 42*a*, 42*b*, and having opposite magnetic polarity to the magnets 12*a* and 12*b*. Further, as shown in FIG. 6C, a magnet 43 such as alnico (aluminum nickel-cobalt alloy) having a large strength or the like may directly be used in the connector socket 100 side. In this case, as shown in FIG. 6D, a similar magnet 44 may be provided at the side of the connector plug 200. According to the examples shown in FIGS. 6C and 6D, the magnetic flux extends to a greater distance from the plug 100 and the socket 200 so that the attractive force acts from a greater distance. Magnets such as ferrite, samarium, cobalt and so on may be utilized similarly although the magnetic coupling force is slightly weakened.

Figure 6E:
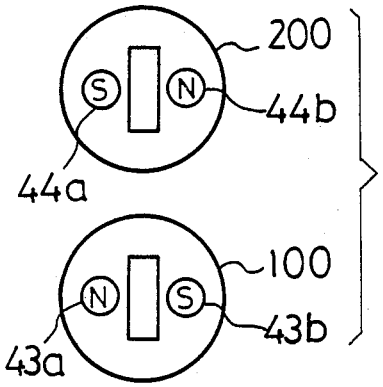

When the connector apparatus employs the magnet constructed as shown in FIG. 6D, a reverse connection is also prevented by choosing the polarities of the magnets 43*a*, 43*b* and 44*a*, 44*b* of the connector socket 100 and the connector plug 200 as shown in FIG. 6E to be opposite. An attempt to incorrectly mate the plug 100 with the socket 200 will be repelled by the force of the magnets.

Further, unlike the above-mentioned embodiment, the connector apparatus can be formed to use the magnet portion as the electrode portion and vice versa.

Furthermore, while the present invention is applied as the connector of the headphone as described above, the present invention is not limited to the above application but can be used as the connector for outdoor audio equipment, e.g. portable tape players.

According to the present invention, as set forth above, since the contacts of the connector socket and the connector plug are kept in contact with each other by magnetic force, the connector plug is easily removed from the connector socket by the application of unintentional tension to the cord regardless of the direction in which the tension is applied. Thus, the cord can be prevented from being broken and the user can be protected from being injured on the head.

In addition, the connector plug can be coupled to and/or removed from the connector socket without friction unlike the conventional socket system. There is then an advantage that the connector plug can be coupled to and/or removed from the connector socket with ease.

The above description is given for the preferred embodiments of the invention but it will be apparent that many modifications and variations could be effected by one skilled in the art without departing from the spirit or scope of the novel concepts of the invention, so that the scope of the invention should be determined by the appended claims only.

We claim as our invention:

1. A connector apparatus for a stereo headphone comprising:

a) a plug including a first housing having a first contact face and a convex mating portion formed on said first contact face, said convex mating portion being in the shape of a truncated pyramid but with one side of the pyramid having a different angle of inclination than the opposite side, a plurality of first terminals including left and right terminals for stereo and an earth terminal, said terminals being accommodated in said first housing and having one end exposed to the outside of said first housing from said convex mating portion, a plurality of electrical leads separately connected between different ones of the other ends of said first terminals and said stereo headphone, and a first magnetic coupling means located at both sides of said convex mating portion; and b) a socket including a second housing having a second contact face and a concave mating portion formed on said second contact face, said concave mating portion being in the shape of a truncated pyramid but with one side of the pyramid and the other side of the pyramid having corresponding angles of inclination to those of said one side and the opposite side of the pyramid of said plug, a plurality of second terminals including left and right terminals for stereo and an earth terminal, said second terminals being accommodated in said second housing and exposed to the outside of said second housing at their ends from said concave mating portion, and a second magnetic coupling means located at both sides of said concave mating portion on said second contact face.

2. A connector apparatus as claimed in claim 1, wherein said first magnetic coupling means comprises a pair of metal plates, and said second magnetic coupling means comprises a pair of magnets.

3. A connector apparatus as claimed in claim 1, wherein said first housing has a cylindrical cord accommodating section in which said plurality of electrical leads are accommodated.

4. A connector apparatus as claimed in claim 1, further including springs accommodated in said second housing and wherein said plurality of second terminals are restrained for limited, sliding movement within said second housing and are biased by said springs to extend their one ends as far out of the second housing as possible.

5. A connector apparatus as claimed in claim 4, wherein said plurality of first and second terminals are each arranged in an in-line fashion.

* * * * *